US005896815A

United States Patent [19]

Sickert

[11] Patent Number: 5,896,815

[45] Date of Patent: Apr. 27, 1999

[54] PUNCH MODULE FOR PRINTING PLATE EXPOSERS

[75] Inventor: Günter Sickert, Dresden, Germany

[73] Assignee: Linotype-Hell AG, Eschborn, Germany

[21] Appl. No.: 08/737,188

[22] PCT Filed: Feb. 23, 1996

[86] PCT No.: PCT/DE96/00308

§ 371 Date: Jan. 30, 1997

§ 102(e) Date: Jan. 30, 1997

[87] PCT Pub. No.: WO96/27499

PCT Pub. Date: Sep. 12, 1996

[30] Foreign Application Priority Data

Mar. 8, 1995 [DE] Germany ..... 195 07 870

[51] Int. Cl.[6] ..... B41N 6/00

[52] U.S. Cl. ..... 101/401.1; 101/401

[58] Field of Search ..... 101/DIG. 36, 401.1, 101/401

[56] References Cited

U.S. PATENT DOCUMENTS

| | | | |
|---|---|---|---|
| 3,585,928 | 6/1971 | Kaneko | 101/401.1 |
| 4,936,212 | 6/1990 | Moss | 101/DIG. 36 |
| 5,500,656 | 3/1996 | Behrens et al. . | |

FOREIGN PATENT DOCUMENTS

| | | |
|---|---|---|
| 0 633 543 | 1/1995 | European Pat. Off. . |
| 41 24 004 | 1/1993 | Germany . |
| 7-013317 | 1/1995 | Japan . |

*Primary Examiner*—Edgar Burr
*Assistant Examiner*—Daniel J. Colilla
*Attorney, Agent, or Firm*—Hill & Simpson

[57] ABSTRACT

A register punch system for printing plates has several punch modules for an interior drum printing plate exposer in which the printing plate is arranged inside a cavity formed of a segment of a circle. The punch modules are arranged next to one another on a base plate at one end of the cavity outside an inside of the cavity in which the printing plate is located. The punch modules each have a guide block arranged on the base plate, a stamping punch guided inside the guide block, a connecting rod for actuating the stamping punch and a stripper plate arranged on the base plate at the end of the base plate facing the cavity and through which the stamping punch is furthermore guided. The stamping punch has a cutting finger at the end that reaches through the stripper plate, the cutting finger reaching over the end of the printing plate. The stamping punch is actuated through the connecting rod, so that a punching is carried out at the end of the printing plate during the drawing back of the stamping punch. The punched-out material of the printing plate is transported away by the cutting finger through the stripper plate.

3 Claims, 2 Drawing Sheets

PUNCH CONFIGURATION

PUNCH MODULE FOR PRINTING PLATE EXPOSERS

BACKGROUND OF THE INVENTION

The invention concerns a punch module for printing plate exposers. In printing technology, printing plates are normally provided with a register punching with which, during clamping onto the printing cylinder of sheet-fed or rotary offset machines, they are positioned at their outer dimensions. The dimensional relation of the printing surface in relation to the printing cylinder is thus produced.

The printing plates are previously exposed in a printing plate exposer and are provided with a register punching. Today, what are known as interior drum exposers are used for this purpose, which are already in use for film exposure. Reference is made here to DE-PS-41 24 004. In the figure of this letters patent, it is shown how a film is placed in the interior drum is exposed. In a printing plate exposer of this type, in place of the film the unexposed printing plate is guided into the cavity from one side and is brought into the exposure position. The interior space of the cavity is occupied by the exposure optics and the transport system, and there is no room to attach a punch in the interior space, with which the register punching could be carried out on the end of the plate.

SUMMARY OF THE INVENTION

An object of the invention is to create a punch module for carrying out the register punching that requires the least possible interior space of the cavity.

According to the invention, a register punch system is provided for a printing plate wherein the printing plate is located in a circular segment cavity of a printing plate exposer. A plurality of punch modules are arranged next to one another on a base plate at one end of the cavity outside and inside of the cavity where the printing plate is located. The punch modules each comprise a guide block arranged on the base plate, a stamping punch guided inside the guide block, a connecting rod for actuating the stamping punch, and a stripper plate on the base plate at an end of the base plate facing the cavity and through which the stamping punch is guided. The stamping punch has a cutting finger at an end that reaches through the stripper plate, the cutting finger reaching over the end of the printing plate so that the stamping punch can be actuated through the connecting rod, a punching being carried out at the end of the printing plate upon a drawing back of the stamping punch, and the punched-out material of the printing plate being transported by the cutting finger through the stripper plate.

In the following, the invention is specified in more detail on the basis of FIGS. 1 to 4. There is shown in:

DESCRIPTION OF THE PREFERRED EMBODIMENTS

Figure 1:
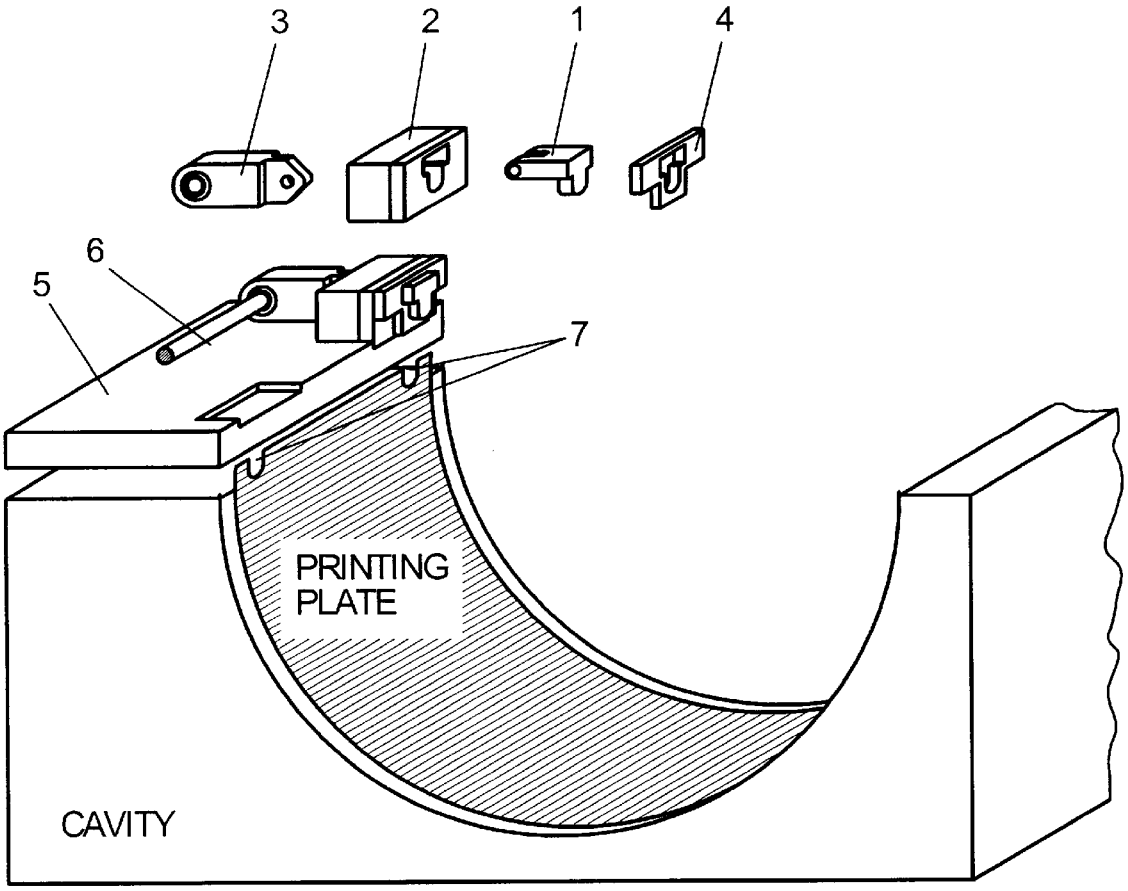
FIG. 1 is a perspective exploded view of the cavity of the plate exposer and of the punch module.

FIG. 1 shows the printing plate as it lies in the cavity of the plate exposer. A punch element is shown in perspective in its individual parts in the upper part of the drawing. The stamping punch 1 is guided in a guide block 2 and is actuated through a connecting rod 3 by means of a cam. The stamping punch 1 runs in addition through a stripper plate 4. The entire construction is fastened on a base plate 5. The connecting rod 3 is actuated by a drive shaft 6. The punched-out recesses 7, which represent the register punching, can be seen at the upper end of the printing plate. According to the register system used, several punch elements can be arranged on the base plate in a spacing predetermined by the respective register system, which is shown later in more detail in FIG. 2.

As can be seen, the entire interior space of the cavity remains free for the optical system and for the transport mechanism (not shown) for the plate. Only the cutting fingers and the stripper plate of the punch element are located in the cavity. A further advantage is that the punched-out material of the plate is transported out of the cavity by the punching itself.

Figure 2:
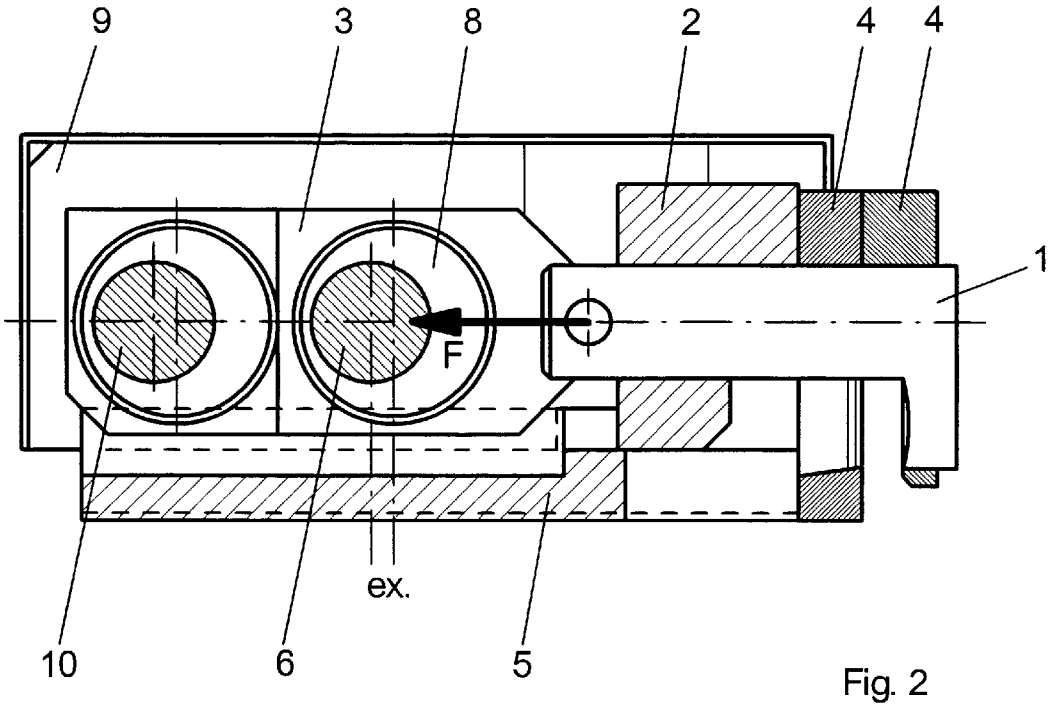
FIG. 2 is a sectional drawing through the punch module.

FIG. 2 shows a register system with 4 punch elements 11, 12, 13 and 14, which together carry out 4punchings on the printing plate. The punch elements 11 and 12 are actuated by a first shaft 6 and the punch elements 13 and 14 by a second shaft 10. As can be seen, the punch elements are of different lengths, according to the shaft by which they are actuated.

Figure 3:
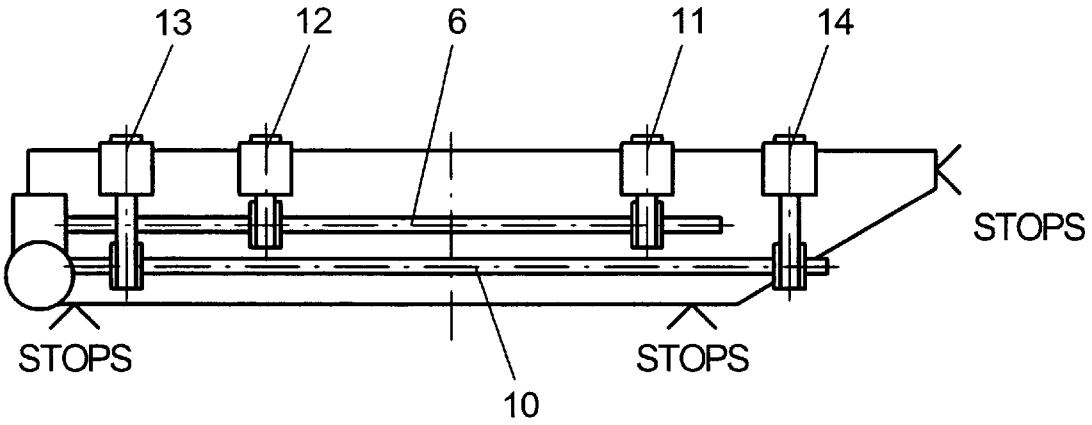
FIG. 3 is an arrangement for a register system with 4 punch modules.

FIG. 3 shows a sectional image through FIG. 2, from which it can be seen that the two shafts 6 and 10 are arranged in one plane above the base plate. The short connecting rod of the punch elements 11 and 12 is designated 3, and the long connecting rod of the punch elements 13 and 14 is designated 9. The direction of pull of the punch is indicated by the letter F.

Figure 4:
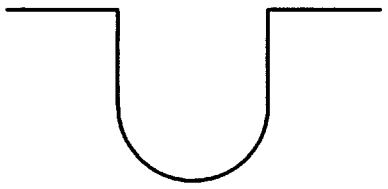
FIG. 4 is an example of a sectional view of the punch.

FIG. 4 shows an example of a punch configuration of the punch. According to requirements, other punch configurations can also be selected. For this purpose, the stamping punch must be correspondingly designed.

Although various minor changes and modifications might be proposed by those skilled in the art, it will be understood that my wish is to include within the claims of the patent warranted hereon all such changes and modifications as reasonably come within my contribution to the art.

I claim as my invention:

1. A register punch system for a printing plate wherein the printing plate is located in a circular segment cavity of a printing plate exposer, comprising:

a plurality of punch modules arranged next to one another on a base plate at one end of the cavity outside an inside of the cavity where the printing plate is located;

the punch modules each comprising a guide block arranged on the base plate, a stamping punch guided inside the guide block, a connecting rod for actuating the stamping punch, and a stripper plate on the base plate at an end of the base plate facing the cavity and through which the stamping punch is guided; and the stamping punch comprising a cutting finger at an end that reaches through the stripper plate, the cutting finger reaching over an end of the printing plate so that the stamping punch can be actuated through the connecting rod, a punching being carried out at the end of the printing plate upon a drawing back of the stamping punch, and punched-out material of the printing plate being transported away by the cutting finger through the stripper plate.

2. The register punch system according to claim 1 wherein several punch modules are arranged on the base plate at a spacing that results from a register system used for the punching, the connecting rods of the individual punch modules being actuated by at least one cam shaft, and the cam shaft being designed eccentrically at least at points at which the cam shaft reaches through the connecting rods.

3. A register punch system for a printing plate wherein the printing plate is located in a cavity of a printing plate exposer, comprising:

a punch module arranged on a base plate at one end of the cavity outside an inside of the cavity where the printing plate is located;

the punch module comprising a guide block arranged on the base plate, a stamping punch guided by the guide block, a connecting rod for actuating the stamping punch, and a stripper plate on the base plate at an end of the base plate facing the cavity and through which the stamping punch is guided; and the stamping punch comprising a cutting finger at an end that reaches through the stripper plate, the cutting finger reaching over an end of the printing plate so that the stamping punch can be actuated through the connecting rod, and the stamping punch being designed so that a punching is carried out at the end of the printing plate upon a drawing back of the stamping punch, and punched-out material of the printing plate being transported away by the cutting finger through the stripper plate.

* * * * *